US005839855A

United States Patent [19]

Anderson et al.

[11] Patent Number: 5,839,855

[45] Date of Patent: Nov. 24, 1998

[54] FACING ELEMENT FOR A STABILIZED EARTH STRUCTURE

[75] Inventors: Peter Anderson, North Reading, Mass.; Michael Joseph Cowell, Leesburg, Va.; Jean-Marc Jailloux, Sannoix, France; Pierre Segrestin, Falls Church, Va.

[73] Assignee: Societe Civile des Brevets Henri C. Vidal, LePecq, France

[21] Appl. No.: 690,487

[22] Filed: Jul. 31, 1996

[30] Foreign Application Priority Data

Aug. 18, 1995 [GB] United Kingdom ..... 9516957
Feb. 29, 1996 [GB] United Kingdom ..... 9604307

[51] Int. Cl.[6] ..... E04B 2/02

[52] U.S. Cl. ..... 405/262; 52/223.7; 52/606; 405/284; 405/286

[58] Field of Search ..... 405/151, 262, 405/284, 286; 52/223.6, 223.7, 223.9, 603, 604, 606

[56] References Cited

U.S. PATENT DOCUMENTS

| | | | |
|---|---|---|---|
| 4,273,476 | 6/1981 | Kotulla et al. | 405/258 |
| 4,671,706 | 6/1987 | Giardini | 405/286 |
| 4,824,293 | 4/1989 | Brown et al. | 405/286 X |
| 4,884,921 | 12/1989 | Smith | 405/286 |
| 4,914,887 | 4/1990 | Meheen | 405/286 X |

FOREIGN PATENT DOCUMENTS

| | | |
|---|---|---|
| 2031077 | 5/1991 | Canada . |
| 0130949 | 1/1985 | European Pat. Off. . |
| 0212357 | 7/1986 | European Pat. Off. . |
| 0378961 | 7/1990 | European Pat. Off. . |
| 0427221 | 5/1991 | European Pat. Off. . |
| 1069361 | 5/1967 | United Kingdom . |
| 1324686 | 7/1973 | United Kingdom . |
| 2014222 | 8/1979 | United Kingdom . |
| 2025496 | 1/1980 | United Kingdom . |
| WO9012927 | 11/1990 | WIPO . |

*Primary Examiner*—Tamara L. Graysay
*Assistant Examiner*—Tara L. Mayo
*Attorney, Agent, or Firm*—Banner & Witcoff Ltd

[57] ABSTRACT

A facing element 20 is formed from cast concrete and provided with a connecting member 23 located in a recess 22. The element is particularly appropriate for use in combination with flexible reinforcing strips. The connecting member may be a simple molded cylinder of plastics or alternatively it may be partly or wholly formed of concrete and be cast integrally with the rest of the facing element. The casting may be facilitated by means of a plastic shell which is set into the concrete and defines the connecting member and recess. To strengthen the connecting member, a reinforcing bar passes through its center.

24 Claims, 9 Drawing Sheets

FIG.11
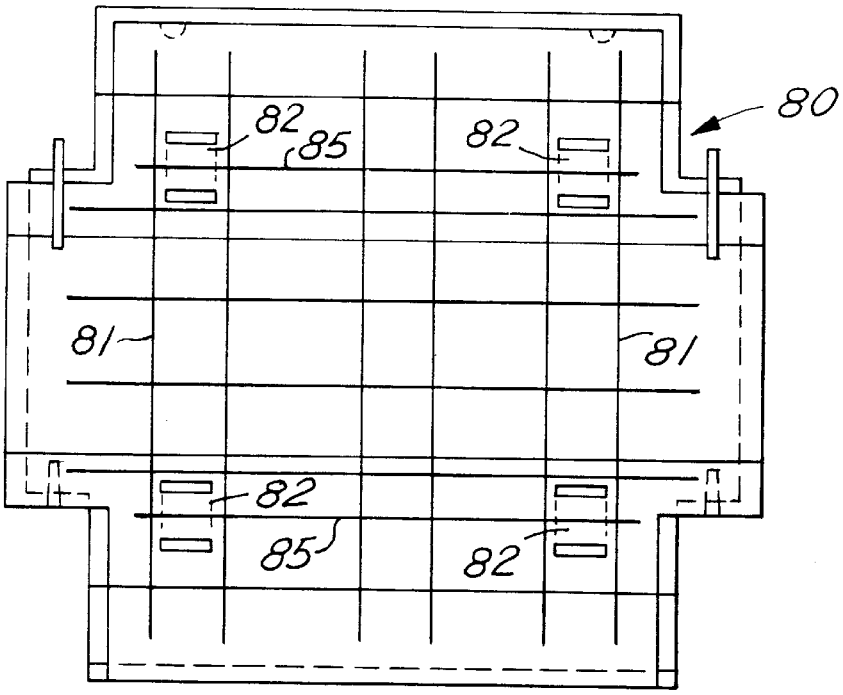
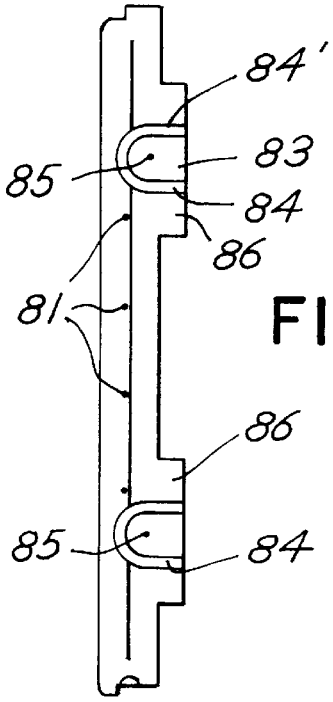
FIG. 12
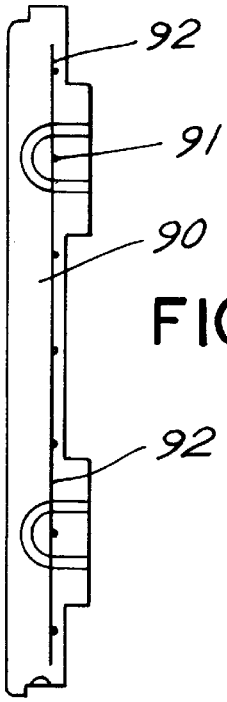
FIG.13

FIG.17
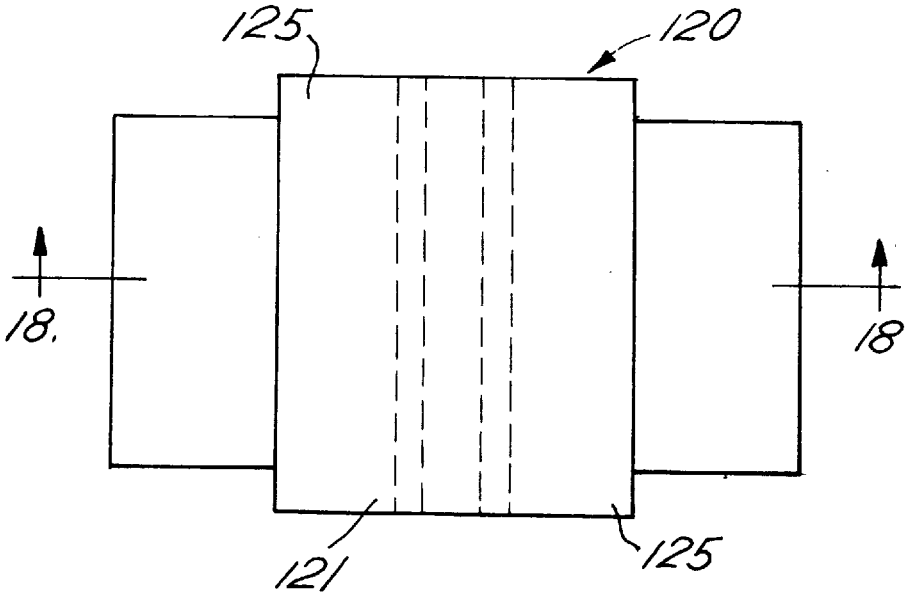
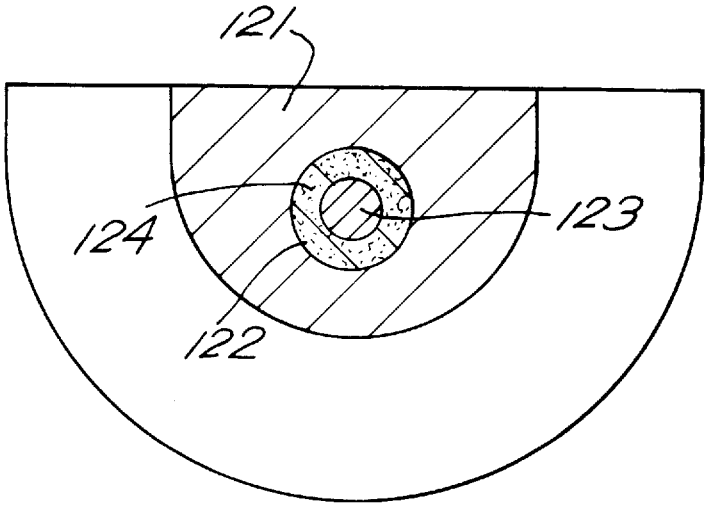
FIG.18

FACING ELEMENT FOR A STABILIZED EARTH STRUCTURE

CROSS REFERENCE TO REPLATED APPLICATIONS

This is related to and corresponds to the following United Kingdom utility patent applications for which priority is claimed pursuant to 35 U.S.C. §119 (a)–(d):

GB 9604307.0 filed Feb. 2, 1996,

GB 9516957.9 filed Aug. 18, 1995.

BACKGROUND OF THE INVENTION

This invention relates to stabilized earth structures and, in particular, to facing elements for use in such structures.

A stabilized earth structure is one in which stabilizing elements are combined with backfill, such as earth, in order to form a composite material. The stabilizing elements extend rearwardly from a facing into the backfill and are spaced from each other. Such structures are commonly employed to provide retaining walls and abutments for bridges. They are known from, for example, GB-A-1069361.

The stabilizing elements have traditionally been provided in the form of metal strips having a length of between 3 and 10 meters, although shorter strips and occasionally longer ones of up to about 20 meters may be used. The width of the strips is generally between 4 and 6 centimeters although it is known to use strips of up to 10 or 25 centimeters in width.

In use, the stabilizing members of a stabilized earth structure are normally directly connected to the facing of the structure which comprises a plurality of facing elements. These may, for example, be molded from a hardenable material such as concrete or they may be grids of bars or wires made of e.g. steel.

It is also known to use large sheets of so-called geotextile or geosynthetic material in place of the metal strips. Such an arrangement is described in EP-A-0378961, in which sheets of geotextile are combined with a rigid mesh to provide a stabilizing element having an extremely large surface area.

A further form of stabilizing element is the flexible strip. This is an elongate, narrow piece of, for example, geotextile that is used in a broadly similar manner to the metal strips referred to above, e.g. as shown in GB-A-2025496 where the strips are passed around a metal bar connected to the rear of the facing elements. U.S. Pat. No. 4,273,476 also illustrates the use of flexible strips passed around a metal bar which in this case is set into the rear face of the element.

While this form of connection is convenient, it does suffer from certain drawbacks. In particular, the backfill material in certain situations, for example, where seawater may intrude into a stabilized earth structure, may be highly corrosive. Clearly, in such situations, the use of an exposed steel bar to form the connection between the facing and the stabilizing strip is undesirable. While U.S. Pat. No. 4,273,476 suggests that the bar may be PVC coated (presumably by dipping), such a coating is, of necessity, quite thin and is subject to damage by abrasion against the backfill and, indeed the stabilizing strips themselves.

SUMMARY OF THE INVENTION

According to a first aspect of the invention, there is provided a facing element for use in a stabilized earth structure, the rear surface of the facing element being provided with a recessed connecting member comprising a molded or cast portion around which may be passed an elongate flexible earth stabilizing strip.

Thus, by means of the present invention, the requirement for an exposed or thinly coated bar is avoided, thereby greatly increasing the resistance of the structure to corrosion. In addition, much more flexibility is provided in the choice of the shape of the connecting member. For example, the connecting member can be made much larger than would be possible if it just comprised a bar. This allows a greater contact area with the stabilizing strip, thereby reducing the pressure applied to the contacting parts of the strip and facing element. It is also possible to accommodate strips which cannot be folded to sharp angles by forming the molded or cast portion with a curved profile having a comparatively large radius.

Although a variety of profiles for the recess are possible, provided that they can accommodate an earth stabilizing member, preferably the recessed connector defines an inner wall of a generally C-shaped passage having an arcuate outer wall. This facilitates the passage of a stabilizing member around the molded or cast portion. Preferably, the connecting member is more than half the diameter of the outer wall C-shaped passage, and/or 40 mm or more in diameter.

In certain constructions, it may be convenient for the molded or cast portion to be forced separately from the rest of the facing element and subsequently to be connected thereto, for example, by being bolted into a pre-formed recess. However, it is preferred for the molded or cast portion to be integrally molded or cast with or into the rest of the facing as this simplifies construction and provides a stronger structure.

In one construction, the molded or cast portion comprises cast concrete which is formed integrally with the concrete body of the facing element. Thus, a complete element, including its connecting member(s), may be provided in one process without the need for any separate components. However, if a high tensile force is likely to be present on the stabilizing member which is connected to the connecting member, then it is preferred that the molded or cast portion be provided with reinforcement. Thus, the connecting member, preferably comprises a core surrounded by the molded or cast portion. For example, a concrete panel may have a connecting member with a core made of steel or a non-corroding material such as polymer or fiber-glass. Such a core may be provided by means of a standard reinforcing bar set into the concrete forming the connecting member. Alternatively, if the panel is reinforced with a standard steel reinforcing grid, the connecting member may be located so that part of the grid forms a core.

Another construction of facing element is to form the molded or cast portion separately from the rest of the element, e.g. as a plastic molding. Such a molding may comprise only a simple member (e.g. a molded cylinder) around which a stabilizing strip may be looped, but preferably it comprises an insert secured to the main body of the facing element which may incorporate means for defining the entire connecting member and may include a reinforcing core. In a particularly preferred form, an outer shell defines a passage around a central member through which the stabilizing strip may be passed. It may also have one or more projectings to secure it into the facing element. There may be lips on the molding which in the finished element lie generally flush with the rear of the facing. These assist in locating the molding in position and provide a seal to prevent the ingress of water.

It will be appreciated that the reinforcing core discussed above is also advantageous in other forms of connecting member. The moldings previously described may be formed around a reinforcing bar, or a bore may be formed in them into which a bar may be inserted. The bore may be over-size to provide space for resin or grout around the bar.

Some forms of stabilizing member, particularly those formed of geotextile material, may be damaged by being chafed against concrete, or by chemical attack resulting from the alkaline nature of concrete. It may therefore be preferred that, where a concrete connecting member is used, it may be isolated from the stabilizing member with which it is used. This may conveniently be achieved by providing an insert e.g. of plastic which surrounds a concrete connecting member. Such an insert may be in the form of a resilient tube having an opening along one side which may be placed over the connecting member, but preferably it comprises a plastic shell. It is preferably cast into the body of the facing element. This prevents the risk of loss of the insert.

In a preferred form, the insert is designed to assist in the casting of the facing element by acting as a former against which the molded or cast portion is molded or cast. Such a shell may be placed into the mold from which the facing element is produced. As concrete is added to the mold, it will flow around and into the appropriate parts of the insert in order to form the portion around which the stabilizing strip is passed in use. It will be appreciated that this arrangement is different from the molding first discussed since, in the present case, the strength of the connector is provided by the concrete, with the shell acting as a mold and isolating the concrete from the stabilizing strip.

The provision of such an insert is, in itself, believed to be inventive, and thus, from a second aspect, there is provided a facing element for use in a stabilized earth structure, the rear of the facing element being provided with an insert having a connecting member around which a stabilizing member may be passed, and the insert having an outer portion which together with the connecting member defines a passage for the stabilizing member.

In a particularly preferred form, the insert itself forms a recess. Preferably, the part of the insert forming the portion around which the stabilizing strip is passed, is provided with meeiis for locating a reinforcing bar in order to reinforce the connecting member as discussed above. By this means, the reinforcing bar is held in place in the center of the connecting member and concrete may flow around it on all sides. This ensures that no portion of the reinforcing bar is exposed which could lead to it corroding.

In order to assist in securing the insert to the body of the facing element, it may additionally be provided with one or more projections to engage therewith. A further refinement is to provide lips on the insert for forming a seal against the rear face of the facing element. Such lips may be arranged to lie against or flush with the rear face of the element, particularly at the periphery of the insert.

An alternative way to form the recess and connecting member provides a third aspect to the invention. It comprises the steps of locating a tool within the concrete to define a recess, allowing the concrete to set and subsequently removing the tool. Such a tool excludes concrete from the area which is used to form the recess while leaving a central portion of concrete within the recess which forms the connecting member. The tool could be positioned in the mold before the concrete is poured in, or it could be pressed into wet concrete already within the mold.

It is particularly convenient to use a tool having two molding arms, each corresponding to half of a C-shaped recess. The central part of the "C", where the two molding arms join, is placed most deeply into the concrete with the end potions of the molding arms projecting therefrom. The connecting member is provided by the concrete which sets within the center of the "C". Once the concrete has set, the two arms of the tool are withdrawn from opposite sides of the connecting member. Most conveniently, both molding arms are connected to a common axis around which they may pivot independently of each other. Handles may be provided to give leverage in order to assist in the removal of the molding arms from the concrete.

Thus, a fourth aspect for the invention provides a tool for use in the method of the third aspect, the tool comprising two molding arms which meet to form a generally C-shaped recess with a concrete portion in the center of the recess, the tool being formed such that it is removable from the facing element when the concrete has set.

In use, the facing elements of the first aspect of the invention may be connected to stabilizing members by simply passing the members through the recess and around the connecting member. An effective way of doing this is to provide a double length stabilizing member which is folded in half with the fold located around the connecting member. The two ends may be provided on top of each other within the backfill material, but it is preferred for them to be offset in the form of a V when viewed in plan.

Alternatively, only one end of a stabilizing member may project a significant distance from the facing element. In this case, it is necessary to prevent the stabilizing member from being pulled away from the facing element. This could be achieved by means of a bulbous portion on one end of the stabilizing member or by clamping the stabilizing member to itself having passed it around the connecting member. However, it is presently preferred to connect a single end of a stabilizing member to the connecting member by passing one of its ends around the connecting member, then around a rod of, for example, a hard plastics material or polymer such as PVC or HDPE and then passing the end of the stabilizing member back around to the connecting member. As the long end of the stabilizing member is pulled, the rod is pulled against the facing element so as to clamp the stabilizing member against the element. Preferably, the rod is shaped so that it may fit into the recess above or below the connecting member in order to clamp the stabilizing member against the facing element and the connecting member simultaneously. Thus, only the stabilizing member will project rearwardly from the facing element with the connecting arrangement being entirely recessed. This may assist during compaction of the backfill.

The recess within which the connection member is located should preferably be slightly wider than the strip which is used in order to allow easy insertion of the strip while preserving the maximum strength of the connecting member and facing element. Thus, preferably the width of the recess is similar to the widths given previously for the preferred widths of stabilizing members. A typical width of recess is, for example, 140 mm.

If desired, the facing element may have a thickened portion, for example, a bulbous part or a rib, on its front or rear surface, in the region where the recessed connector is provided. If a rib is provided, this preferably extends across the facing element. In this way, the strength may be increased. However, preferably, the facing element otherwise has a substantially flat rear surface. This improves the ease of transport, handling and storage of the elements.

It is also advantageous when the facing element is produced by casting, for example, using concrete, for the rear of the element to be generally flat. This allows the flat rear surface to be formed as the top surface in an open topped mold. If ribs are provided, extra components may be used at the top of the mold to form these.

The present invention extends to a structure incorporating the facing elements and stabilizing members described herein. Thus, according to a fifth aspect of the invention, there is provided a stabilized earth structure comprising earth stabilized by stabilizing elements as described herein, the stabilizing elements being connected to a facing comprising a plurality of facing elements as described herein.

BRIEF DESCRIPTION OF THE DRAWING

Certain embodiments of the invention will now be described by way of example only and with reference to the accompanying drawings in which:

FIG. 11 is a schematic plan view of a third embodiment of facing element;

FIG. 12 is an end elevation of the embodiment of FIG. 11;

FIG. 13 is an end elevation, corresponding to FIG. 12, of a fourth embodiment of facing element;

FIG. 17 is a plan view of a molded connection member; and

FIG. 18 is a sectional view along the line 18—18 of FIG. 17.

DESCRIPTION OF THE PREFERRED EMBODIMENT

Figure 1:
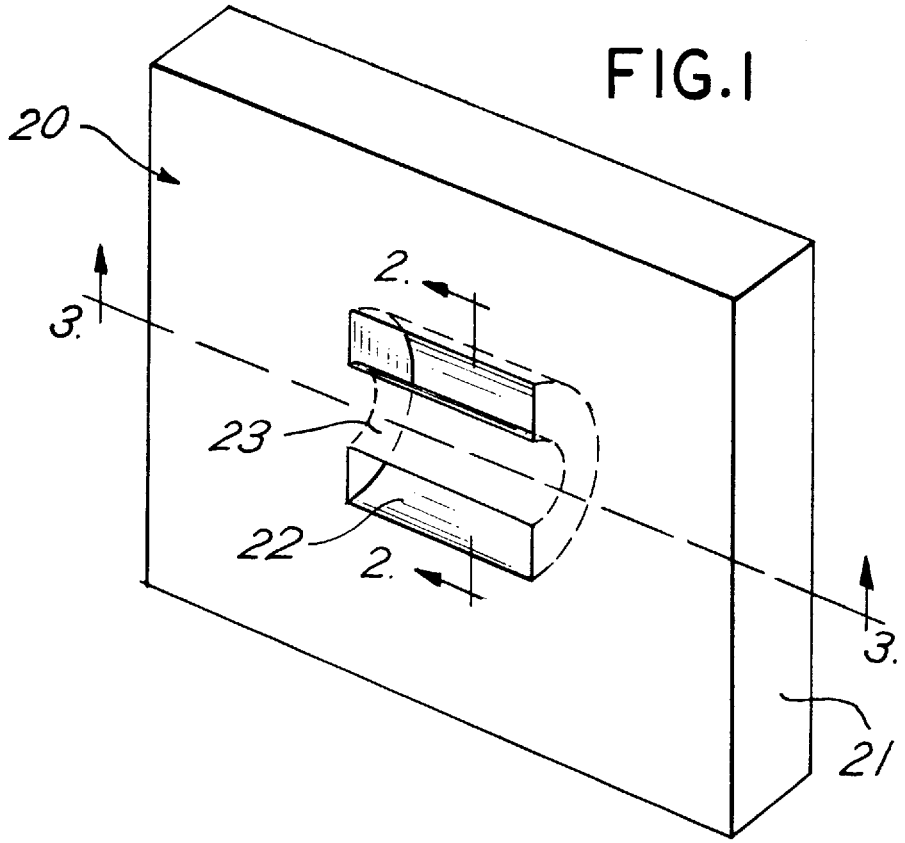
FIG. 1 is a schematic perspective view of a first embodiment of facing element.

FIG. 1 illustrates schematically a facing element 20. The facing element 20 comprises a generally rectangular concrete panel 21 in which is cast a recess 22 and a connecting member 23. In practice, the facing element 20 would probably be provided with projections or the like along its edges in order to assist in alignment with further facing elements 20 to provide a complete facing for a stabilized earth structure. Such arrangements are known in the art and therefore they will not be discussed further herein.

In the illustrated embodiment, a single connecting member 23 is located in the center of the rear face of the facing element 20. However, if large facing elements 20 are to be used, it may be appropriate to provide a number of connecting members 23.

The illustrated connecting member 23 is generally D-shaped in cross-section with the straight side of the D lying flush with the rear surface of the facing element 20. A recess 22, in the shape of a C, allows a stabilizing strip to be passed freely around the connecting member 23.

Figure 2:
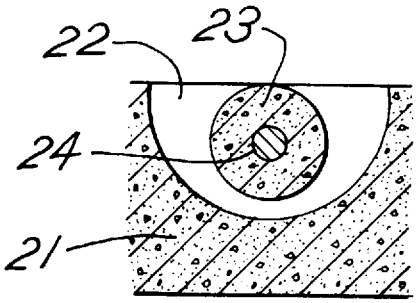
FIG. 2 is a sectional view of a modified facing element, corresponding to line 2—2 of FIG. 1.
Figure 3:
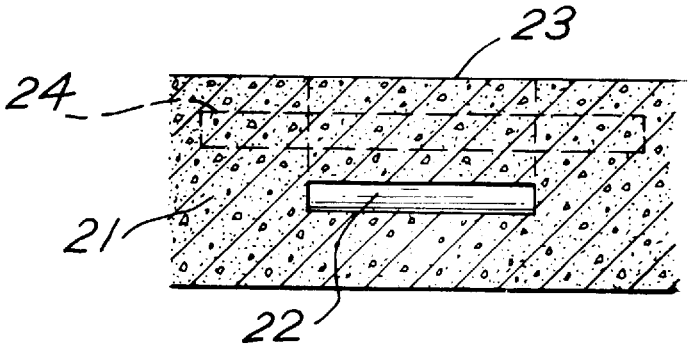
FIG. 3 is a sectional view along line 3—3 of FIG. 1.

FIG. 2 shows a sectional view through a slightly modified facing element in which the connecting member is somewhat more circular in section than that previously described in order to avoid having sharp edges against which a stabilizing strip could chafe. FIG. 2 also shows the use of a steel reinforcing bar 24 which is located in the center of the connecting member 23 in order to increase its strength. The bar 24 is completely encased in concrete and is therefore not exposed to the environment. The reinforcing bar is shown in phantom in FIG. 3.

Figure 4:
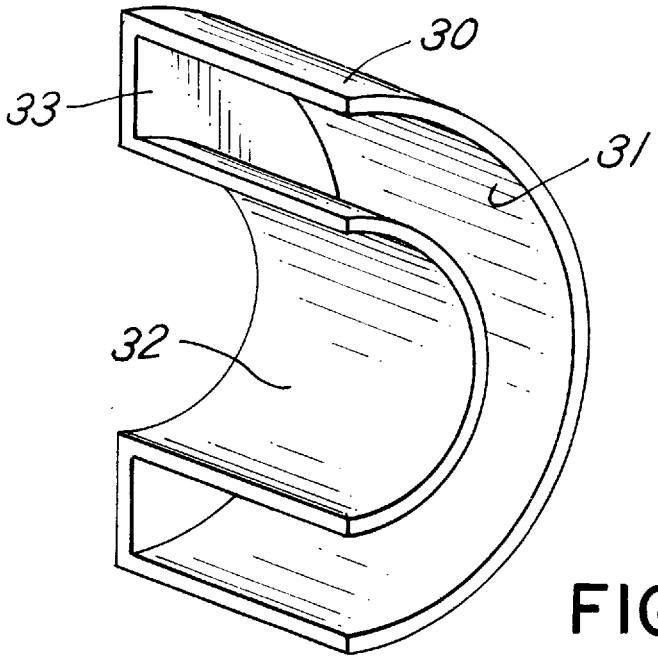
FIG. 4 is a cutaway perspective view of a shell for forming the recess and connecting member of FIG. 1.

As discussed previously, certain types of reinforcing strips should preferably not be allowed to come into contact with concrete. In order to avoid this, a plastic shell 30 (see FIG. 4) may be employed. The shell 30 defines a first arcuate portion 31 which corresponds to the recess 22 and a second arcuate portion 32 corresponding to the connecting member 23. It will be appreciated that if such a shell 30 is located within recess 22, then a stabilizing member may pass within the first portion 31 of the plastic shell 30 and will not come into contact with the concrete forming the facing element 20. The plastic shell 30 also has end portions 33, which prevent the edges of the stabilizing strip from coming into contact with concrete of the the facing element 20.

The illustrated shell 30 is designed to be cast into the facing element 20 when it is produced. In fact, the shell 30 actually assists in forming the element 20 since, provided that concrete is not allowed to flow into the first portion 31, but is allowed to flow into the second portion 32, the shell acts as a mold for the connecting member 23 and recess 22. For example, the shell 30 could be provided with its opening resting on the bottom of a mold, which subsequently is filed with concrete. The bottom of the mold would prevent the entry of concrete into the first portion 31, but it would be able to flow into or about the second portion 32 in order to form the connecting member 23. Alternatively, if the bottom of the mold is used to form the front of the facing element, then the plastics shell 30 could be positioned at the top of the mold and the concrete would then be poured into the mold.

Figure 5:
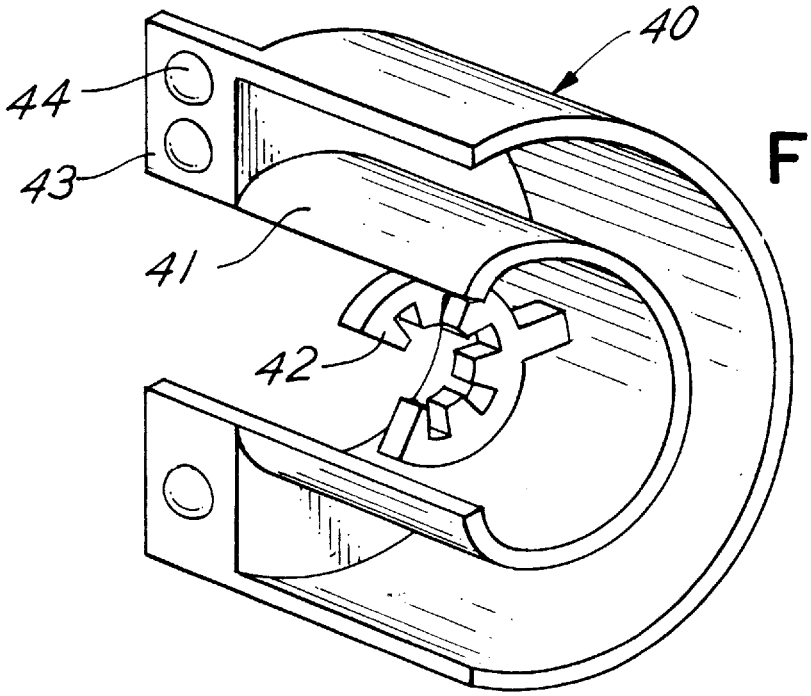
FIG. 5 is a view corresponding to FIG. 7 of an alternative shell.

A more complex plastic shell 40 is illustrated in FIG. 5. This corresponds generally in shape to the shell 30, but is modified in certain significant respects. The wall which surrounds the connecting member of the facing element is provided with curved edges 41 in order to produce a substantially cylindrical connecting member 23 (such as that shown in FIG. 8). In addition, a pair of lugs 42 (one shown) are provided for holding a reinforcing bar in place in the center of the connecting element while the facing element is molded. This ensures that the reinforcing bar lies within the center of the connecting member 23 so that no portion of it is exposed to the environment. Finally, projections 43 extend from each corner of the shell. These will, in use, lie against the rear of the facing element 20 and may serve to assist in the location of the shell 40 if it is pushed into a mold. Generally hemispherical spacers 44 are provided on each projection and these will project from the rear of a completed facing element. Their function is to provide a small gap between facing elements 20 when they are stacked in order to prevent damage by abrasion and to assist in lifting one element 20 to the top of a stack.

Figure 6:
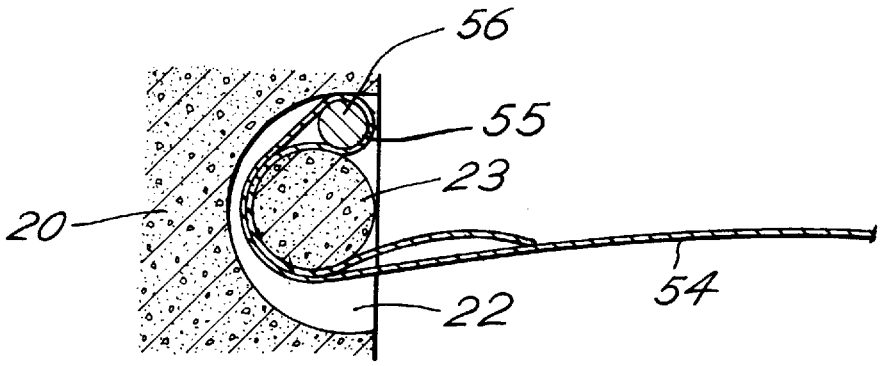
FIG. 6 is a sectional view corresponding generally to FIG. 2 illustrating the connection of a stabilizing strip to a facing element.
Figure 7:
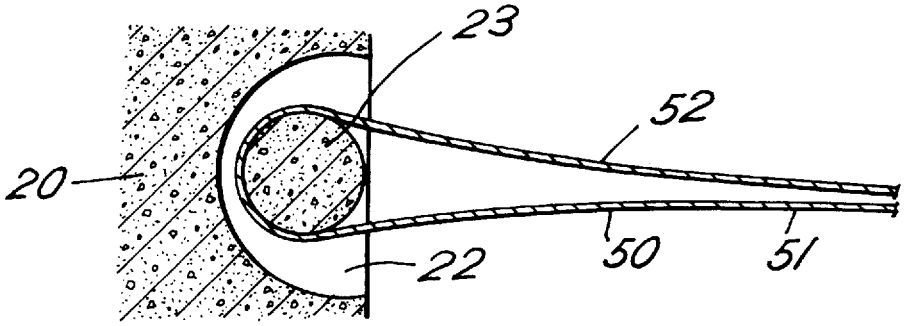
FIG. 7 is a similar view to FIG. 6 illustrating an alternative method of connection.

As explained above, flexible stabilizing strips may be attached to facing elements 20 of the type just described by passing the strip around the back of the connecting member 23. FIGS. 6 and 7 are sectional views corresponding to FIG. 2 illustrating two ways in which this may be achieved. The most simple of these is illustrated in FIG. 7 in which a long stabilizing strip 50 has a first end 51 extending from the backfill material to the connecting member 23 around which it passes and then extends back into the backfill material as a second part 52. In this way, a single piece of stabilizing strip provides the function of two of the known metal stabilizing strips.

If it is desired to have only a single stabilizing strip extending from a facing element then the arrangement shown in FIG. 6 may be used. Here, a short portion at one end of the strip 54 is folded over to form a double portion, and this is passed around the back of the connecting member 23. When the folded portion 55 of the stabilizing strip 54 passes back out of the recess, a PVC rod 55 is inserted inside the fold. The stabilizing strip may then be pulled back into the position illustrated in FIG. 6, in which the PVC rod 56 is within the recess 22, so as to clamp the stabilizing element against the walls of the recess. If the stabilizing strip 54 is pulled away from the facing element 20, this will tend to pull the PVC rod further into the recess 22 and in this way will increase the clamping effect on the strip 54. In order to further improve this effect, the PVC rod 56 may be provided with a cross-section which closely matches the inside of the recess 22.

Figure 8:
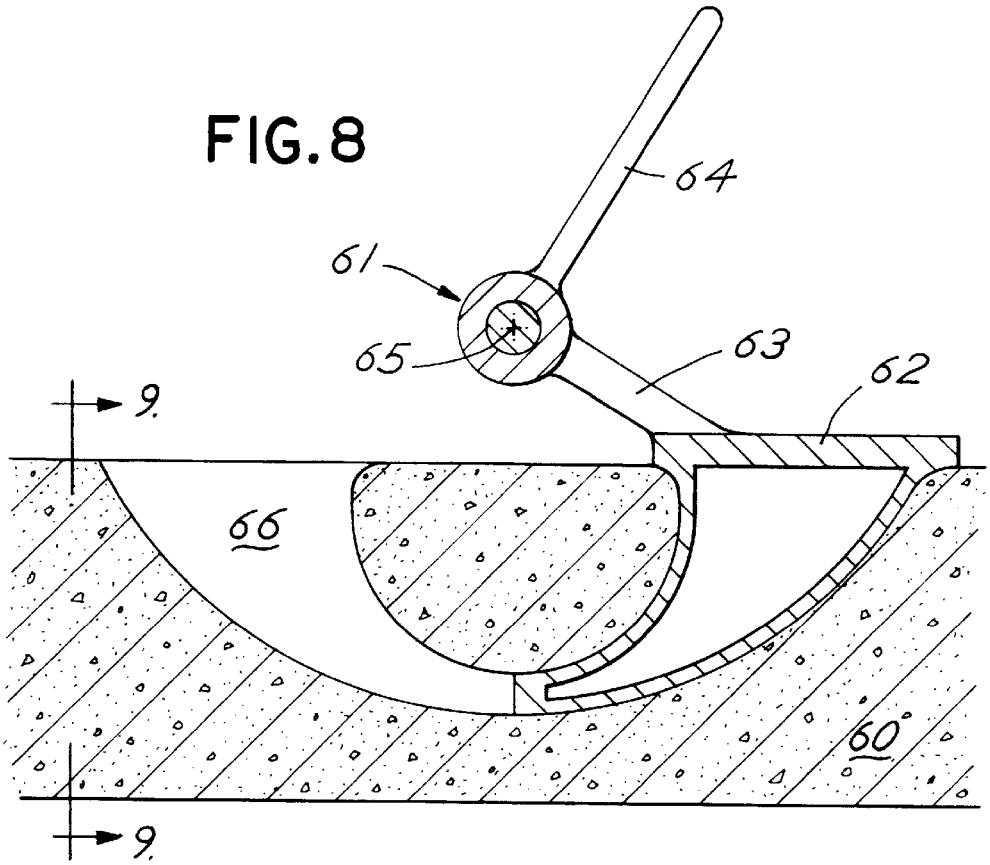
FIG. 8 is a sectional view through the connection member of a second embodiment of facing element showing a tool used for its production.
Figure 9:
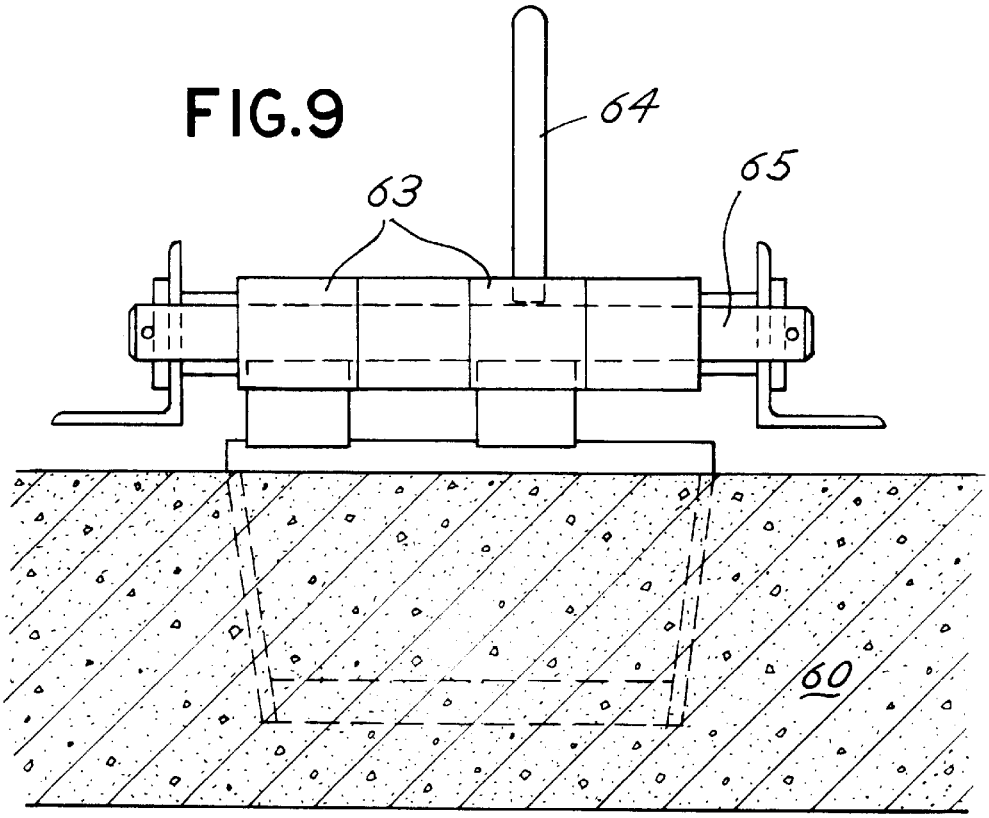
FIG. 9 is a further sectional view of the facing element and tool of FIG. 6 corresponding to line 9—9 of FIG. 8.
Figure 10:
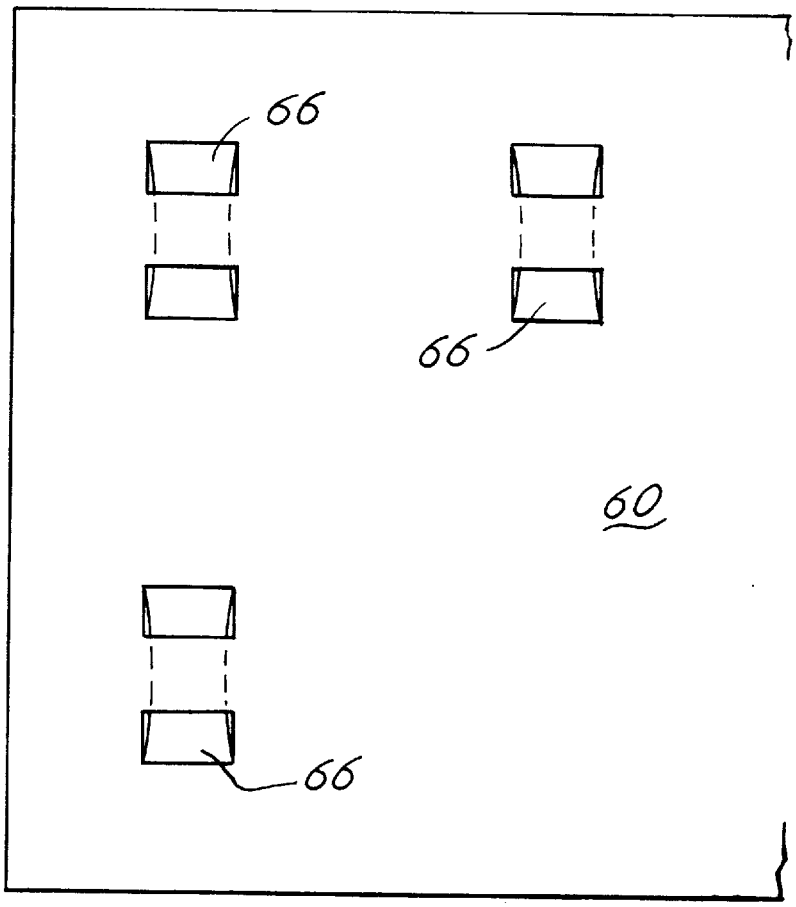
FIG. 10 is an elevation of the rear of the facing element of FIGS. 8 and 9.

FIGS. 8 to 10 concern a second embodiment of facing element 60 in which a specialized tool 61 is used to provide the recess and connecting member. As will be seen from FIG. 8 (which shows only half of the tool which is, in fact, generally symmetrical), the tool has a pair of molding arms 62 which are in the shape of the recess which is to be formed. These are connected by means of shafts 63 to handles 64. The handles and shafts are arranged to move together about an axle 65. FIG. 12 illustrates the way in which the components are mounted on the axle 65. The molding arms 62 may be pivoted about the axle 65 by means of the handles 64 in order to move them towards and away from each other like the jaws of a pair of pincers.

In use, the molding arms 62 are brought together and set into the wet concrete which is to form the facing element 60. When the concrete is sufficiently well cured, the handles 64 are pushed together which moves the molding arms 62 apart and withdraws them from the concrete. This leaves a recessed portion 66 behind.

This method of construction may be particularly appropriate where it is not necessary to provide a stabilizing strip protecting shell in the facing element although it remains possible to place a protective plastics sheet in position afterwards. It will be appreciated that the tool may be reused as often as required. FIG. 10 illustrates schematically the rear view of a facing element 60 having a number (three shown) of recesses formed in the manner just described.

A third embodiment is illustrated schematically in FIG. 11. The facing element 80 is cruciform in shape and has lips around its edges for interengagement with other like panels. The contrast to the previously described embodiments, it is reinforced by means of a steel reinforcing grid 81. The grid 81 is cast into the concrete facing element 80 in the conventional manner.

The facing element 80 is provided with four connecting members 82 having generally the same form as that illustrated in FIG. 1. As may be seen from FIG. 12, these each comprise a central portion 83 provided in a recess 84 in the facing element 80. This defines a passage 84 through which a stabilizing strip may be passed. In order to strengthen the connection between a stabilizing strip and the facing element, two steel reinforcing bars 85 are cast into the concrete. Each of these passes through the center of two connecting members 82. As may be seen from FIG. 12, to facilitate construction, the reinforcing bars 85 are provided in a different plane from the reinforcing grid 81. In order to accommodate the connecting members, the facing element 80 is formed with two horizontal ribs 86 which provide regions of increased thickness.

FIG. 13 shows a fourth embodiment facing element 90 which is a modified versions of that just described. The modification is that certain parts 91 of the horizontal bars forming the reinforcing grid 92 are used to reinforce the connecting members. As may be noted from the Figure, this is achieved by displacing the reinforcing grid rearwardly as compared to FIG. 12 and ensuring that the horizontal bars forming the grid 92 are aligned with the connecting members.

Figure 14:
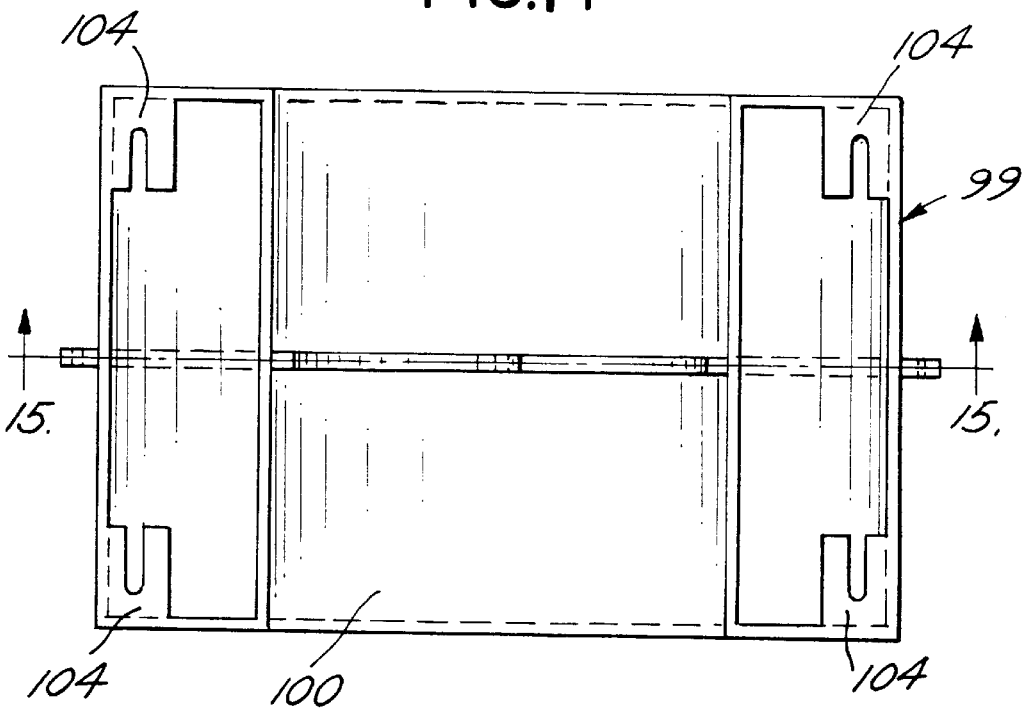
FIG. 14 is a plan view of a connection member forming shell.
Figure 15:
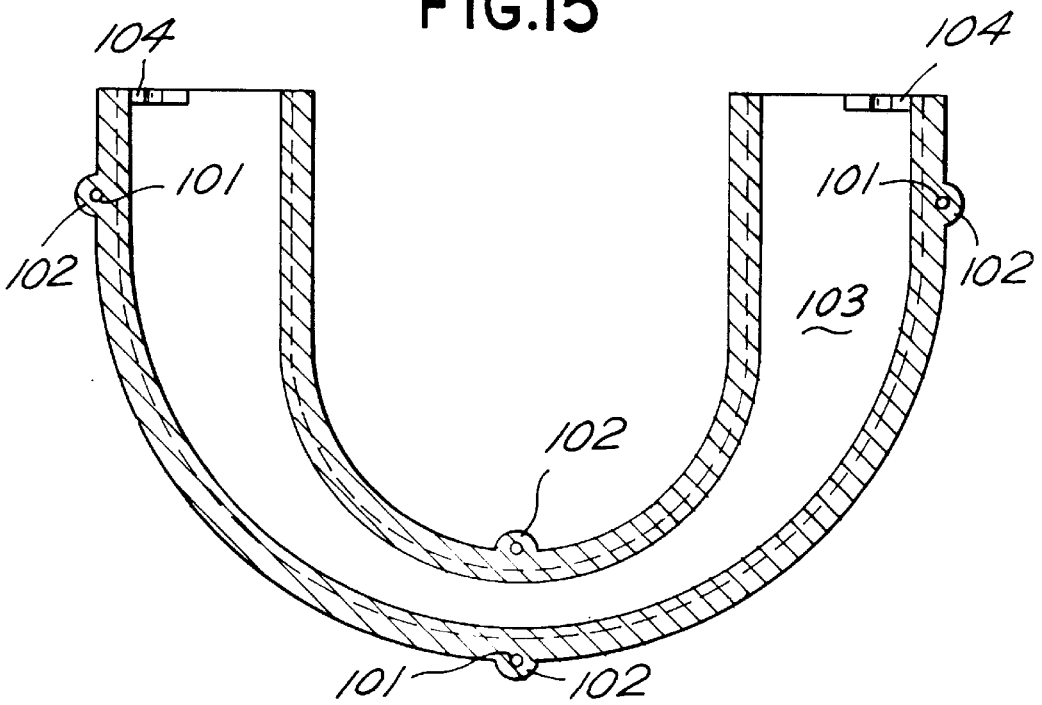
FIG. 15 is a sectional view along 15—15 of FIG. 14.

Turning now to FIGS. 14 and 15, there is illustrated a plastic shell 100 which is used in the formation of the connecting members of the third and fourth embodiments. It is broadly similar to the shell illustrated in FIG. 4, but contains certain modifications to assist in the construction of the facing element. The shell 100 is formed in two mirror image halves, which are connected together along the center line 15—15 of FIG. 14. They may be bonded by means of epoxy resin or simply be wired together using the holes 101 in tabs 102. As may be seen from FIG. 15, the shell 100 defines a generally U-shaped passageway 103, as in the previously defined embodiments. At the upper face of the shell 100, four slotted tabs 104 are provided, only at each corner, to secure the shell 100 in position during the casting process, as will be described below.

Figure 16:
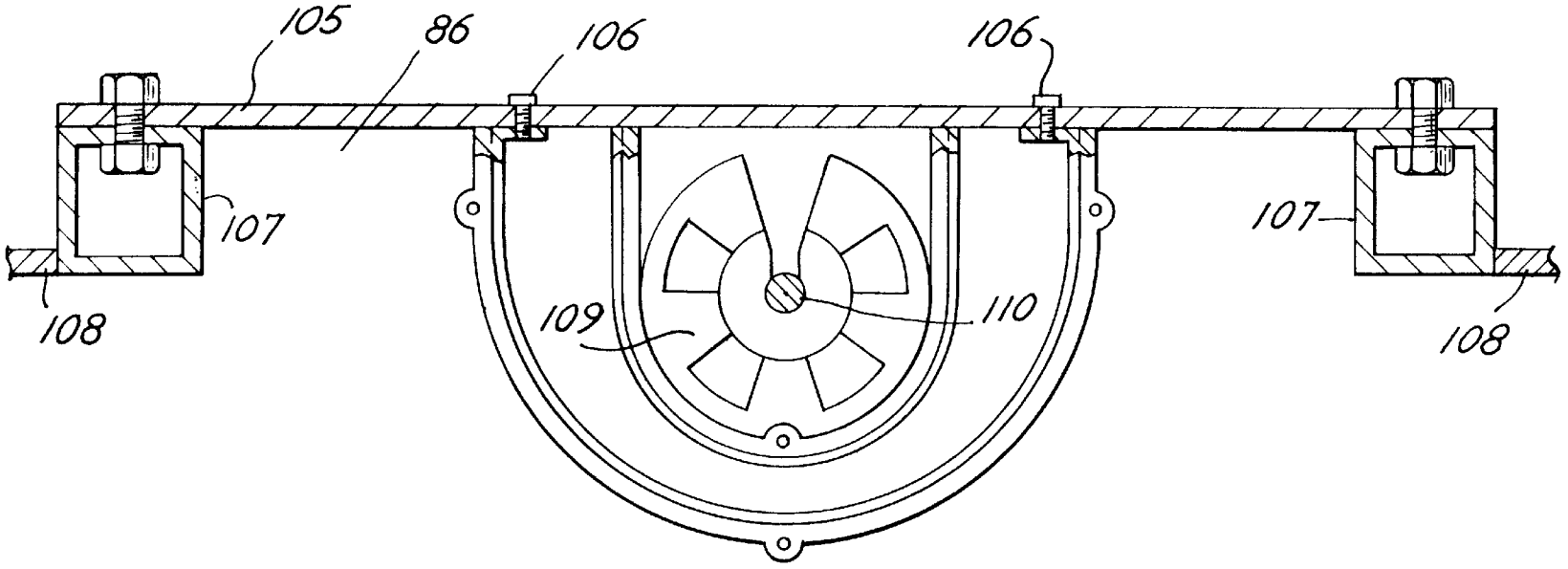
FIG. 16 is a sectional view of a facing element incorporating the shell of FIG. 14.

FIG. 16 illustrates the shell just described being used to construct a facing element. the shell 100 is secured to steel plate 105 by means of four screws 106 and the slotted tabs 104. The steel plate 105 is bolted to steel bar sections 107 which are, in turn, secured to further steel plates 108. This assembly forms part of the top of a mold for a facing element. As may be seen from the drawing, the region between the box sections defines one of the ribs 86.

In the center of the shell, a reinforcing bar holder 109 is provided having an outside diameter corresponding to the inside diameter of the shell. This holds a standard steel reinforcing 110 bar (corresponding to bar 82 of FIG. 11 or grid portion 91 of FIG. 13) in the normal manner, thereby ensuring that it is completely encased in concrete when the casting is finished. When the mold is filled, the concrete flows into the rib and around the shell. It also flows into the central part of the shell, and around the reinforcing bar, thereby forming a single integral casting.

An alternative method of construction uses a different plastic molding which forms a complete connecting member. Such a molding 120 is shown in FIGS. 17 and 18. The outer shape and configuration of this is similar to that of the shell just described. However, its central portion 121 is a solid, except for a cylindrical bore 122 through the center. The bore 122 is sufficiently large to accommodate a reinforcing bar 123 which is secured in place by means of grout or epoxy resin 124.

This connecting member is located in a concrete facing during the molding process in a similar way to that described in relation to FIG. 16. However, it will be appreciated that no concrete flows into the central portion 121. However, the reinforcing bar 123 is cast into and extends across the facing element in the same way as bar 82 of FIG. 11. In order to ensure a water tight seal is provided between the plastic connector member 120 and the remainder of the facing element, lips 125 are provided at the top (in relation to the molding process) for the central portion. It will be appreciated that these extend laterally on the rear of the finished panel beyond the point where the reinforcing bar enters the concrete. This ensures that the reinforcing bar 123 is protected from corrosion.

While various examples of the invention have been set forth, the invention is to be limited only by the following claims and their equivalents.

What is claimed is:

1. A facing element for use in a stabilized earth structure, said element being molded or cast from a material to provide a main body with a rear surface, the rear surface of the facing element being provided with a molded or cast recess having an integrally molded or cast connecting member of said material around which may be passed an earth stabilizing member.

2. A facing element as claimed in claim 1 wherein the connecting member includes a reinforcing core.

3. A facing element as claimed in claim 1 or claim 2, wherein the connecting member comprises an insert secured in facing element.

4. A facing element as claimed in claim 3, wherein the insert provides a former against which the connecting member is molded or cast.

5. A facing element as claimed in claim 3, wherein the insert has one or more projections to assist in securing it to the main body of the facing element.

6. A facing element as claimed in claim 3, further comprising lips on the insert for forming a seal against the rear face of the facing element.

7. A facing element as claimed in claim 3, wherein the insert is made of plastic.

8. A facing element as claimed in claim 1, wherein the recessed connecting member defines an inner wall of a generally C-shaped passage having an arcuate outer wall.

9. A facing element as claimed in claim 8, wherein the connecting member has a surface which is at least partially cylindrical around which a stabilizing member may be passed, the diameter of said surface being more than half the diameter of the arcuate outer wall of the generally C-shaped passage.

10. A facing element as claimed in claim 1, wherein the connecting member is more than 40 mm in diameter.

11. A facing element as claimed in claim 1, in combination with a discrete rod which in use cooperates with the connecting member to clamp said stabilizing member to the facing element.

12. A stabilized earth structure comprising, in combination, the facing element of claim 1, flexible stabilizing elements engaging the recessed connecting member, and compacted soil over the stabilizing elements.

13. A facing element for use in a stabilized earth structure, said element having a rear side, said rear side of the facing element including an insert shell cast into the facing element, said shell having a connecting member around which a stabilizing member may be passed and the shell further having an outer portion which, together with the connecting member, defines a passage for the stabilizing member.

14. A facing element for use in a stabilized earth structure, said element molded or cast from a material, said element having a rear surface with a molded or cast recess therein, said recess including a molded or cast connecting member of said material with a reinforced core, said connecting member comprising a portion of the facing element around which may be passed an earth stabilizing member.

15. A facing element for use in a stabilized earth structure, said element molded or cast from a material to provide a main body, said main body having a rear surface, an insert secured in the main body at the rear surface, said insert defining a form at least in part for the molded or cast material, said insert including a connecting member around which may be passed an earth stabilizing member.

16. A facing element for use in a stabilized earth structure, said element molded or cast from a material to provide a main body, said main body having a rear surface, an insert secured in the main body at the rear surface providing a recess in the main body to define a molded or cast connecting member of said material, said insert further including projections engaging against the rear surface.

17. A facing element for use in a stabilized earth structure, said element molded or cast from a material, to provide a main body, said element having a rear surface with a recess and a connecting member of said material in the recess, said connecting member defining an inner wall of a generally C-shaped passage having an arcuate outer wall.

18. The facing element of claim 17 or claim 20 or claim 21 wherein the passage includes open ends through the rear face and a middle portion, said middle portion being more narrow than at least one end.

19. The facing element of claim 17 or claim 21 in combination with a discrete rod which cooperates with the connecting member to clamp said stabilizing member to the facing element.

20. A facing element construction for use in a stabilized earth structure, said construction including an element molded or cast from a material to provide a main body, a passage in the molded or cast material defined by a recessed connecting member of said material in the main body around which an earth stabilizing member may be passed, and a discrete rod which in use cooperates with the connecting member to clamp said stabilizing member to the facing element.

21. A facing element for use in a stabilized earth structure, said element including a main body molded or cast from a material with a rear surface, and a recess in the rear surface having a connecting member in the recess around which may be passed an earth stabilizing member, and an insert in the main body including a first wall portion corresponding, at least in part, to the recess and a second wall portion corresponding to the connecting member in the recess, said wall portions defining a passage.

22. The facing element of claim 21 wherein the insert further includes side portions.

23. The facing element of claim 21 wherein the insert includes side projections overlying the rear surface.

24. The facing element of claim 21 wherein the insert includes spacing projections overlying the rear surface.

* * * * *